US006486785B1

(12) United States Patent
Hoth

(10) Patent No.: US 6,486,785 B1
(45) Date of Patent: Nov. 26, 2002

(54) METHOD OF TAKING INFRARED TEMPERATURE READINGS THROUGH A WILDLIFE SHIELD FOR ELECTRICAL EQUIPMENT

(75) Inventor: William Hoth, Clearwater, FL (US)

(73) Assignee: Universal Thermography, Inc., Clearwater, FL (US)

( * ) Notice: Subject to any disclaimer, the term of this patent is extended or adjusted under 35 U.S.C. 154(b) by 0 days.

(21) Appl. No.: 09/923,057

(22) Filed: Aug. 6, 2001

(51) Int. Cl.[7] ..... G08B 17/00

(52) U.S. Cl. ..... 340/584; 340/588; 340/589; 250/443.1

(58) Field of Search ..... 340/584, 588, 340/589, 600, 621; 374/1, 45, 186; 250/443.1, 316.1, 338.1, 339.06

(56) References Cited

U.S. PATENT DOCUMENTS

| | | | | |
|---|---|---|---|---|
| 3,766,310 A | | 10/1973 | Paschen | 174/138 F |
| 4,136,372 A | | 1/1979 | Oak | 361/131 |
| 4,201,883 A | | 5/1980 | Shepherd | 174/139 |
| 4,845,307 A | | 7/1989 | Cumming et al. | 174/5 R |
| 4,906,801 A | | 3/1990 | Beasley | 174/5 R |
| 5,157,334 A | * | 10/1992 | Lowther | 324/501 |
| 5,650,594 A | | 7/1997 | Urnovitz | 174/139 |
| 5,682,015 A | | 10/1997 | Harben | 175/5 R |
| 5,794,495 A | | 8/1998 | Anderson | 81/53 |
| 6,005,196 A | | 12/1999 | Spillyards | 174/138 F |
| 6,226,933 B1 | * | 5/2001 | Nelson et al. | 52/101 |
| 6,248,956 B1 | * | 6/2001 | Cook et al. | 174/155 |
| 6,255,597 B1 | * | 7/2001 | Bowling et al. | 174/138 F |
| 6,291,774 B1 | * | 9/2001 | Williams | 174/139 |

* cited by examiner

*Primary Examiner*—Daniel J. Wu
*Assistant Examiner*—Phung Nguyen
(74) *Attorney, Agent, or Firm*—Larson & Larson, PA; James E. Larson

(57) ABSTRACT

Providing an animal shield having two halves snapped together around an electrical bushing and connector. The animal shield has a multiplicity of closely spaced apart openings substantially covering its body. An infrared camera is aimed at the animal shield and the temperature output of the electrical bushing and connector are recorded. If the temperature reading shows a temperature output of more than 5° F. over ambient, a report is made so that the bushing and connector can be serviced by appropriate personnel.

3 Claims, 7 Drawing Sheets

METHOD OF TAKING INFRARED TEMPERATURE READINGS THROUGH A WILDLIFE SHIELD FOR ELECTRICAL EQUIPMENT

FIELD OF THE INVENTION

This invention relates to shields for protecting electrical bushings from wildlife. More particularly, it refers to a method of taking temperature readings through a wildlife shield for electrical bushings.

BACKGROUND OF THE INVENTION

U.S. Pat. No. 6,005,196 describes a wildlife shield for electrical bushings, but prevents infrared temperature reading of the bushing and connector. Such a temperature reading is necessary to anticipate electrical problems. A temperature reading more than 5° F. above the normal operating temperature ambient of the connector or bushing indicates a loose connection, corroded, overloaded or unbalanced condition requiring immediate attention.

U.S. Pat. No. 5,794,495 is an open animal guard permitting required infrared readings, but does not completely shield bushings and electrical connectors from wildlife.

Other wildlife guards are shown in U.S. Pat. Nos. 5,682,015; 5,650,594; 4,906,801; 4,845,307 and 4,201,883.

A wildlife protector is needed that can be easily installed, completely encloses electrical connectors and bushings and can be used to provide a means for taking infrared temperature readings from time to time of the connectors and bushings.

SUMMARY OF THE INVENTION

The present invention solves the need by providing a method employing a low cost enclosure for electrical connectors and bushings which is easily mounted and provides for passage of infrared radiation to permit temperature readings on the connectors and bushings.

The enclosure has a generally cylindrical non-conductive exterior with an opening at a top and bottom portion adapted to fit over a bushing, connector and electrical lead line. The enclosure has two segmented halves hinged together along a rear vertical hinge line and locked together by a front latch. The generally cylindrical body has multiple closely spaced apart openings with an opening diameter of less than an inch.

The method employs the enclosure mounted over an electrical connector and bushing, aiming an infrared camera at the enclosure, taking a temperature reading of the electrical connector and bushing and reporting a temperature reading more than 5° F. over ambient temperature.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
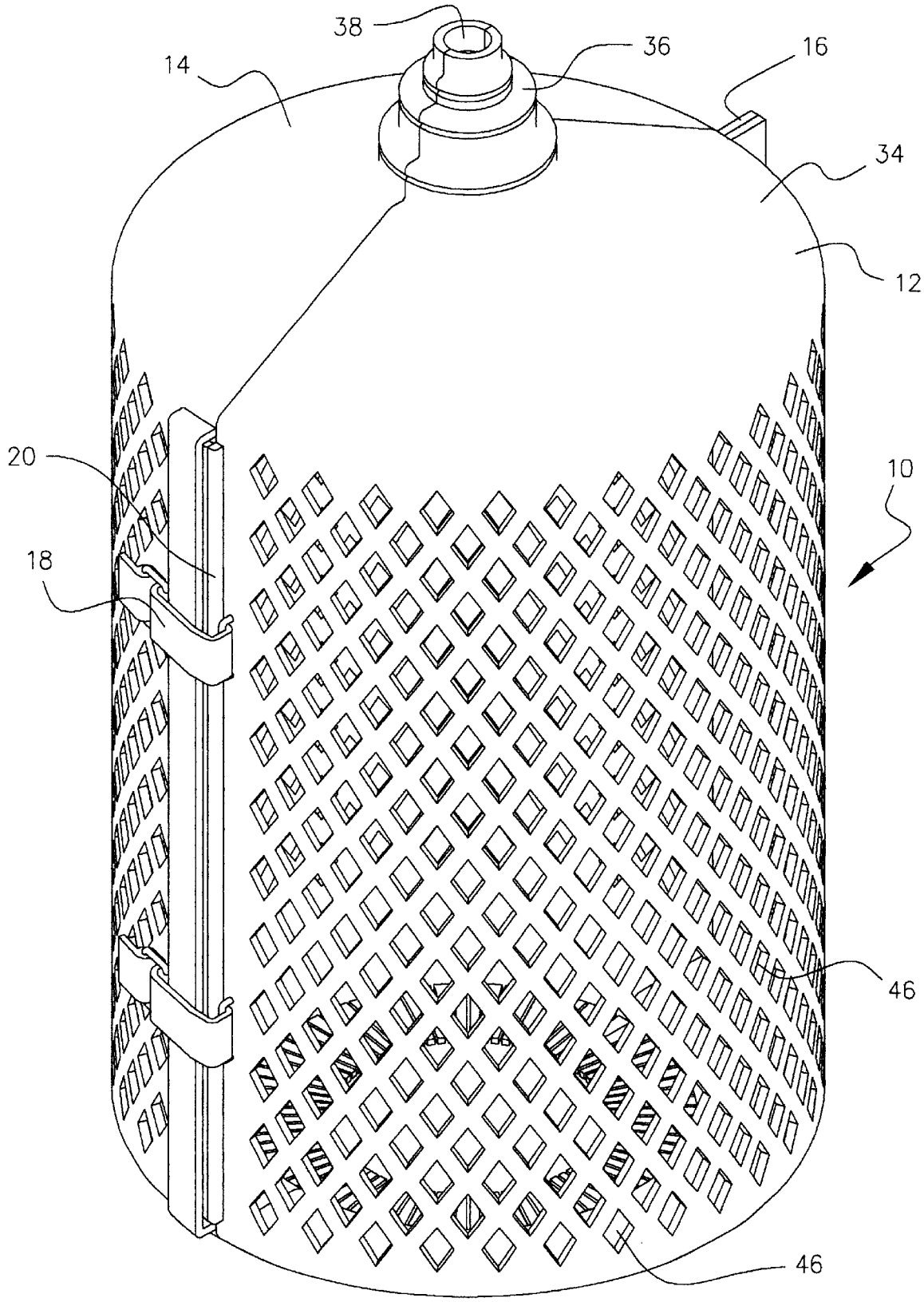
FIG. 1 is a front elevational outside view of a wildlife shield employed in the method of this invention.

Throughout the following detailed description the same reference numerals refer to the same elements in all figures.

Figure 2:
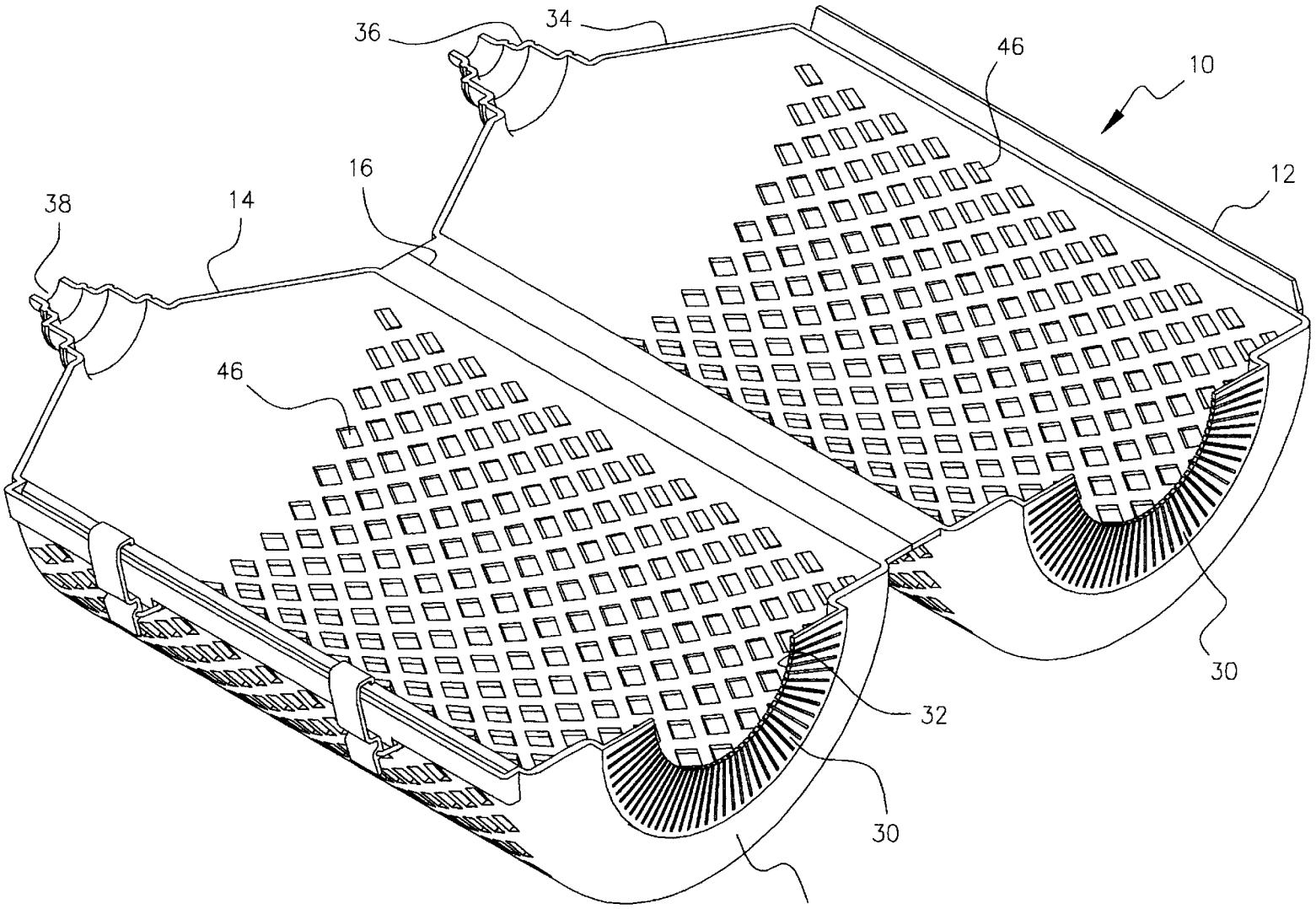
FIG. 2 is a perspective view of the wildlife shield in a hinged open position prior to mounting over an electrical bushing.
Figure 3:
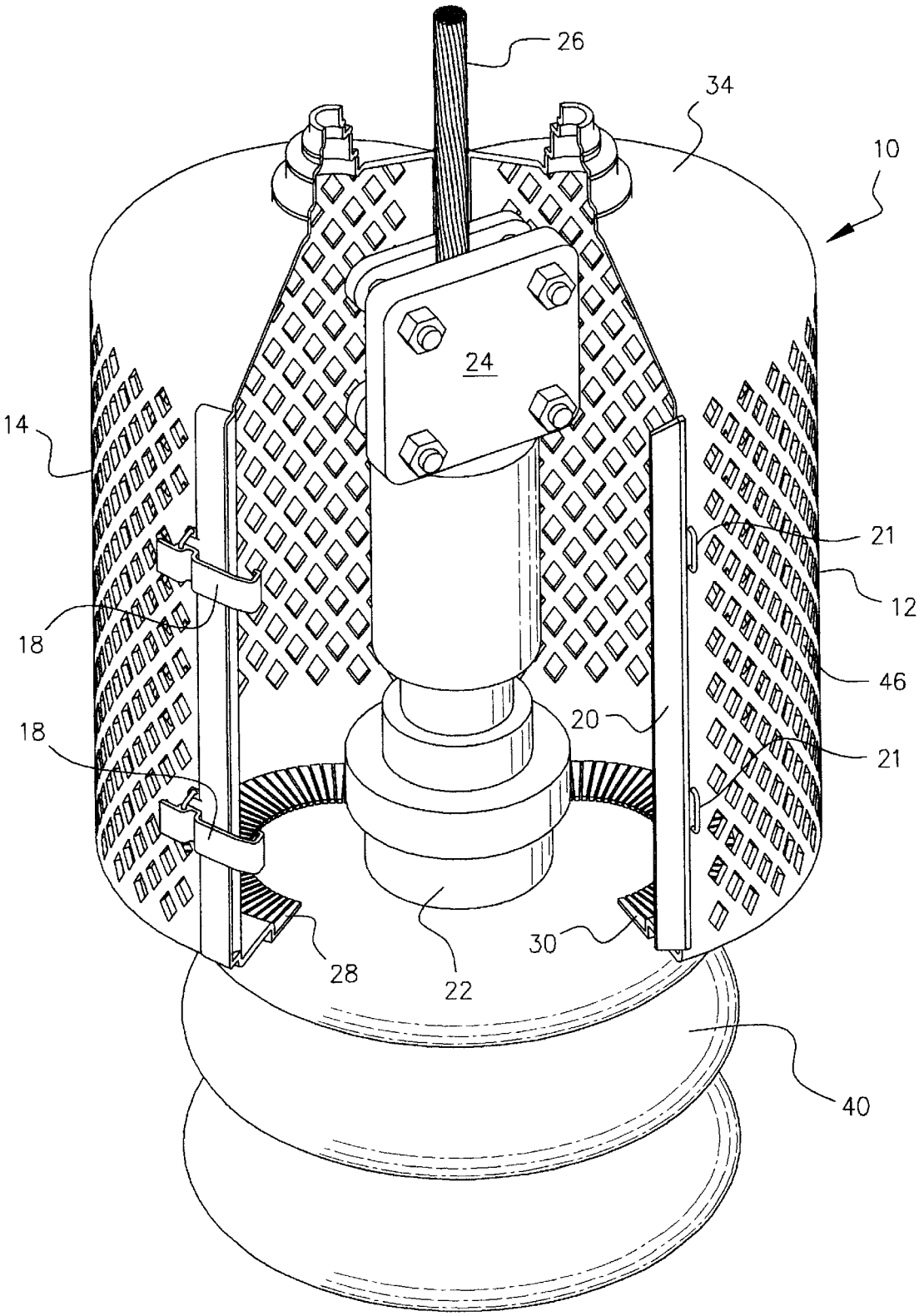
FIG. 3 is a front elevational view of the wildlife shield being mounted around an electrical bushing and connector.
Figure 4:
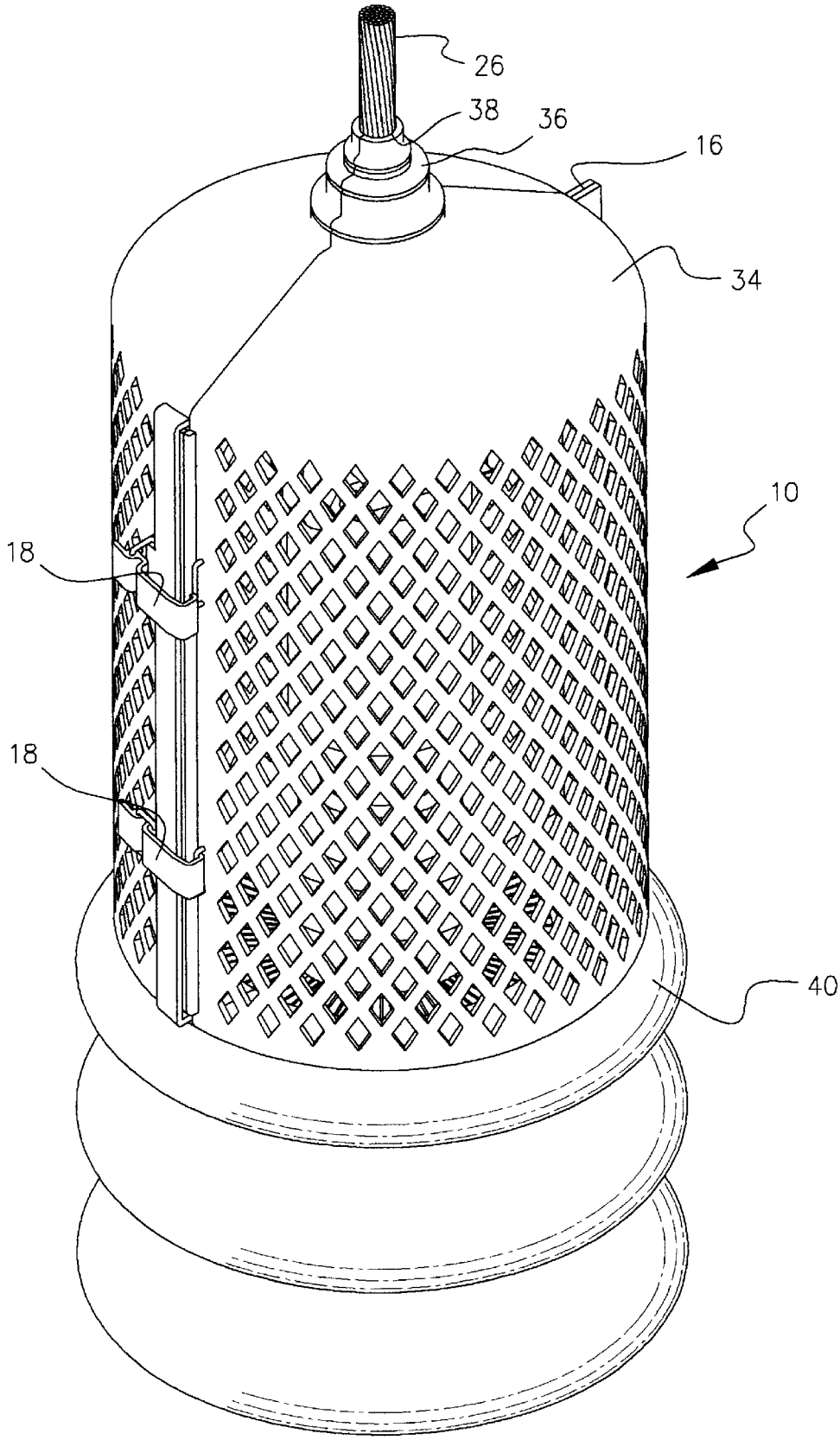
FIG. 4 is a front elevational outside view of the wildlife shield mounted around an electrical bushing and connector and latched in place.
Figure 5:
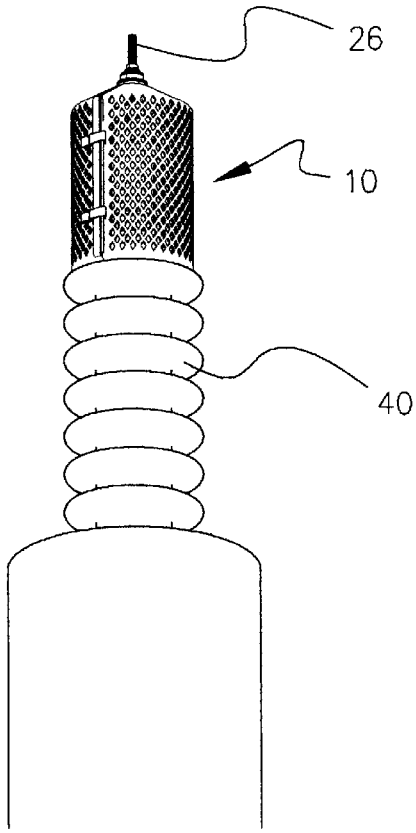
FIG. 5 is a view of a person taking an infrared temperature reading of the bushing and connector through the wildlife shield.
Figure 5:
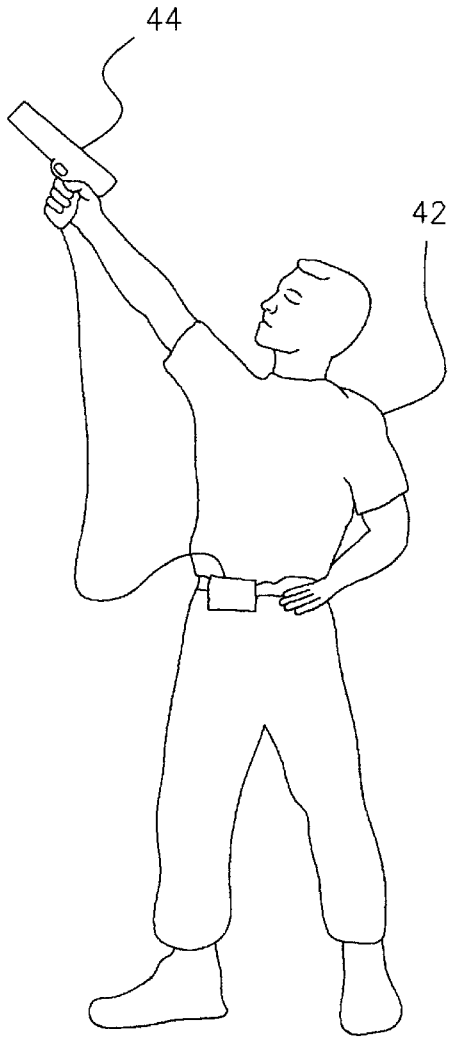

Referring to FIGS. 1–3, the wildlife shield 10 has a first half 12 and a second half 14 made from a UV stable non-conductive plastic such as polypropylene hinged together at hinge line 16. A latch 18 snaps over a latch bar 20 to engage a hook eye 21 to secure the wildlife shield 10 to an electrical bushing 22 and the connector 24 to its lead line 26. A bottom portion 28 of the wildlife shield surrounds the circumferential structure of the bushing 22 with flexible strands 30 providing a collar around aperture 32. A top portion 34 has a raised section 36 with a centrally located hole 38 to provide an exit for the electrical lead line 26. As seen in FIG. 4, the animal shield 10 rests on the ceramic support 40 for bushing 22.

The wildlife shield is engaged around the electrical bushing and snapped together by a utility lineman.

The method of the invention is achieved by a person 42 aiming an infrared camera 44 at the animal shield 10. The infrared camera measures the temperature generated by the electrical bushing 22 and connector 24 inside the animal shield. A reading more than 5° F. above ambient temperature indicates a potential for an electrical component failure caused by a loose, corroded, overloaded or unbalanced connector 24 or lead line 26. Aiming the infrared camera 44 at a prior art animal shield which does not have openings 46 as shown in FIGS. 1–4 gives no reliable reading since the infrared radiation is masked by the solid animal shield.

Figure 6:
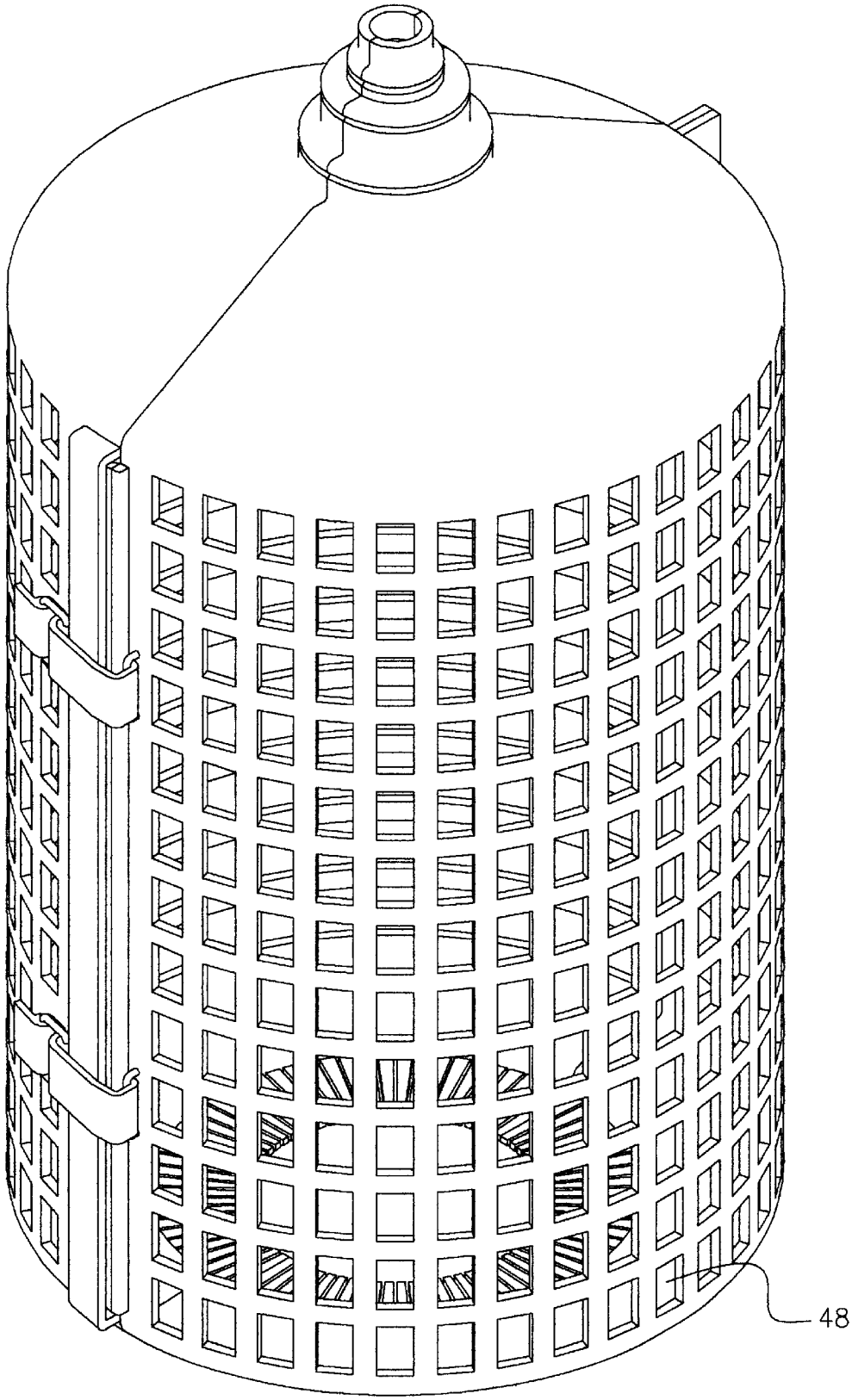
FIG. 6 is a first alternate shape for the apertures in the wildlife shield.
Figure 7:
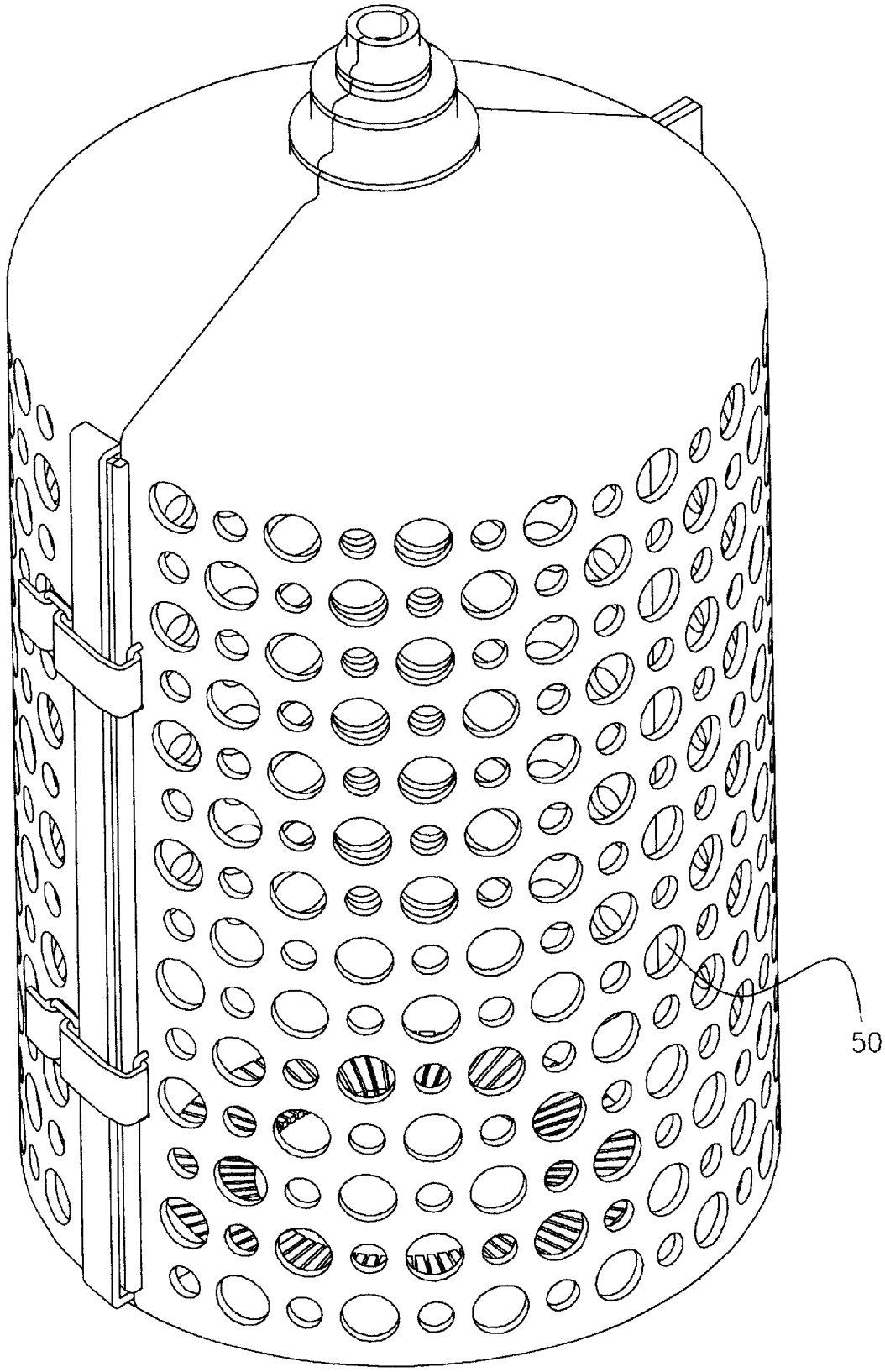
FIG. 7 is a second alternate shape for the apertures in the wildlife shield.

The openings 46 in the animal shield 10 can have a diamond shaped look as in FIGS. 1–5 or alternatively can be square 48 as shown in FIG. 6 or round 50 as shown in FIG. 7.

The diameter of the opening 46, 48 or 50 should be less than one inch to prevent entry of animals and preferably should be ¼ to ½ inch in diameter. A smaller diameter opening reduces the temperature reading efficiency of the infrared camera 44.

The above description has described the method steps embodying the invention. However, it will be within the skill of one having ordinary skill in the art to make modification without departing from the spirit and scope of the underlying inventive concept of this method.

Having thus described the invention in detail the following is claimed:

1. A method of determining excess heat build up in electrical equipment by taking infrared temperature readings of electrical equipment covered by an animal shield, the steps comprising:

a) providing an animal shield having two halves snapped together to completely surround an electrical bushing and connector, the animal shield two halves penetrated by a multiplicity of closely spaced apart openings having a diameter of less than one inch;

b) aiming an infrared camera at the animal shield;

c) recording the temperature output of the electrical bushing and connector, and d) reporting any reading showing heat output of 5° F. over ambient to appropriate servicing personnel.

2. The method according to claim 1 wherein the openings in the animal shield two halves are provided at a diameter of ¼ to ½ inch.

3. The method according to claim 1 wherein the animal shield is provided as a generally cylindrical body having a top opening for an electrical lead line and a bottom opening for enclosing the transformer bushing.

* * * * *